United States Patent [19]

Heckel

[11] Patent Number: 4,564,084

[45] Date of Patent: Jan. 14, 1986

[54] METHOD AND APPARATUS FOR CONTROLLING THE TEMPERATURE OF OIL IN AN OVERHEAD TANK

[75] Inventor: Bruce G. Heckel, Level Green, Pa.

[73] Assignee: Elliott Turbomachinery Co., Inc., Jeannette, Pa.

[21] Appl. No.: 592,130

[22] Filed: Mar. 22, 1984

[51] Int. Cl.[4] ..... F01M 5/00

[52] U.S. Cl. ..... 184/6.11; 184/6.22; 60/39.08

[58] Field of Search ..... 184/6.11, 6.22, 6.4; 60/39.08; 123/196 R

[56] References Cited

U.S. PATENT DOCUMENTS

| | | | |
|---|---|---|---|
| 2,673,571 | 3/1954 | Lerom | 184/6.22 X |
| 3,042,147 | 7/1962 | Hutchings | 184/6.22 |
| 3,114,360 | 12/1963 | Snelling | 184/6.22 X |
| 3,147,821 | 9/1964 | Eggenberger | 123/196 R |
| 3,729,064 | 4/1973 | Wolf et al. | 184/6.22 X |
| 3,779,345 | 12/1973 | Barnes et al. | 60/39.08 X |
| 4,171,611 | 10/1979 | Hueller | 60/39.08 |

*Primary Examiner*—Carlton R. Croyle
*Assistant Examiner*—Jeffrey A. Simenauer
*Attorney, Agent, or Firm*—Robert P. Hayter

[57] ABSTRACT

An oil delivery system for supplying oil to seal a portion of a turbomachine is disclosed. Specific means for routing oil at a desired temperature to an overhead tank are disclosed such that should oil from the overhead tank be required, as in an emergency or shutdown condition, then the oil being supplied from the tank will be at or near the temperature of the oil being supplied during normal operating conditions.

8 Claims, 2 Drawing Figures

METHOD AND APPARATUS FOR CONTROLLING THE TEMPERATURE OF OIL IN AN OVERHEAD TANK

BACKGROUND OF THE INVENTION

This invention relates to a method and apparatus for controlling the temperature of oil maintained in an overhead tank. More specifically the invention concerns rerouting oil being supplied to the seals of a turbomachine to direct a portion of the oil through an overhead tank to maintain the overhead tank oil temperature at a desired level.

Large turbomachines utilize oil seals which prevent gases from escaping along the shaft ends to the environment. Typically these seals are provided with an oil supply system which supplies clean oil under pressure to the seals and receives contaminated oil from the seals. The oil delivery system typically includes a console which acts to supply oil under pressure and receives the discharged oil from the compressor. The console acts to clean and/or filter the oil, to increase or reduce its temperature, to remove pollutants therefrom by various processes and to otherwise condition the oil such that it may be resupplied to the turbomachine under pressure.

Seals used on large turbomachines do require oil for cooling and sealing. The interruption of the flow of oil for sealing purposes results in catastrophic failures. It is known to provide a back-up oil delivery system for maintaining oil flow under pressure to the seals in the event of failure of the oil supply system. It is further known to mount an overhead tank at a desired height containing oil to establish the proper seal differential pressure such that oil may be supplied from the tank to the seals under pressure to provide the necessary sealing on an interim basis.

The overhead tank is located at a height sufficiently above the turbomachine that a static pressure head is created therebetween such that the oil at the desired pressure may be supplied from the tank. The desired pressure level is required since oil must be maintained at a pressure slightly above the gas pressure to prevent leakage of the gas.

In certain plant layouts the overhead tank is mounted quite a distance from the turbomachine and often in an ambient of significantly different temperature conditions. Under these circumstances since the oil in the tank tends to be stagnant except when the tank is being filled or in an emergency situation requiring emptying of the tank, the oil in the tank tends to reach the ambient temperature condition. Should the oil in the tank be much cooler than the desired oil supply temperature, then the viscosity of the oil changes and the volume flow of the oil through the supply lines to the turbomachine may be reduced such that an emergency supply of oil is not provided when necessary. Again should oil of much lower viscosity be supplied thereto the volume flow of oil through the seals will be significantly reduced and the seals may be starved causing damage to the seals and effectively preventing the back-up emergency oil supply system from accomplishing its desired sealing function.

The solution proposed to the problem of the temperature of the oil in the tank not being at the desired operating temperature includes routing a portion of the oil being supplied to the turbomachine through the tank such that the oil in the tank is maintained at the desired operating temperature rather than the ambient temperature of the region where the tank is located. A specific supply system including level sensors and control valve for diverting a portion of the flow of sealing oil to the tank is set forth herein.

SUMMARY OF THE INVENTION

It is an object of the present invention to provide apparatus for adequately supplying oil to a turbomachine from a tank when conditions warrant.

It is a further object of the present invention to provide a back-up supply of oil for servicing seals of a turbomachine should the normal oil supply fail for any reason.

It is a still further object of the present invention to provide a method and apparatus for maintaining the temperature of the oil in an overhead oil tank at a desired temperature level without regard to the ambient temperature in the region surrounding the overhead tank.

It is a yet further object of the present invention to provide a control means and method for allowing a portion of the oil being supplied to the seals of a turbomachine to be routed through an overhead tank for maintaining the temperaure of the tank while simultaneously maintaining the static head pressure differential between the tank and the seals to allow the tank to serve the appropriate back-up oil supply function.

It is a still further object of the present invention to provide a reliable, cost effective and easily maintainable system for maintaining the temperature of oil in an overhead tank at a desired level.

Other objects will be apparent from the description to follow and the appended claims.

The above objects are achieved according to a preferred embodiment of the invention by providing an oil delivery system for supplying oil to a portion of the turbomachine having a pressurized fluid flowing therethrough. The oil delivery system includes an oil supply means for supplying oil under pressure to the turbomachine and for receiving oil from the turbomachine. A first conduit connecting an oil supply means to the turbomachine, and a second conduit connecting the turbomachine to the oil supply means are further included. A tank which is at least partially filled with oil is connected to the first conduit via a discharge line. The tank is mounted at an elevation sufficiently above the turbomachine that oil may be routed from the tank through the discharge line and the first conduit to the turbomachine at a pressure higher than the pressure of the fluid received by the turbomachine. Additionally means for altering the temperature of the oil in the tank to approximate the operating temperature of the oil in the oil delivery system are included.

Additionally disclosed is a method of maintaining a reliable alternate source of oil using a tank positioned vertically above a turbomachine while maintaining the desired relative pressure of the oil supplied from the tank, said tank being a portion of an oil delivery system for supplying oil for sealing purposes to the turbomachine and including an oil supply means for supplying oil under pressure and for receiving oil, first conduit means for conducting oil from the oil supply means to the turbomachine, second conduit means for conducting oil from the turbomachine to the oil supply means and a discharge line connecting the tank to the first conduit means, and including the step of regulating the temperature of the oil in the tank to maintain the desired oil flow characteristics.

DESCRIPTION OF THE PREFERRED EMBODIMENT

Apparatus as described herein will refer to a oil delivery system used with a compressor for increasing the temperature and pressure of a fluid. It is to be understood that this oil delivery system has applicability to other types of turbomachinery in addition to compressors. It is further to be understood that although the oil delivery system as shown herein is used to direct oil to the seals of the compressor that the oil delivery system may be used for other purposes such as maintaining bearing lubrication pressures and may be used in conjunction with other equipment.

Figure 1:
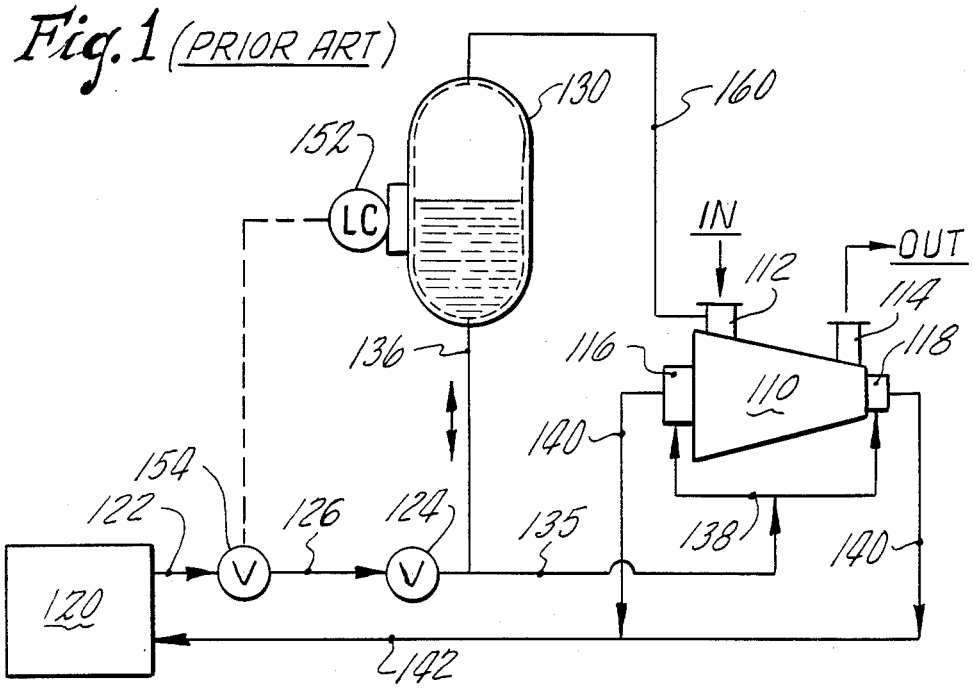
Fig. 1 (PRIOR ART)
FIG. 1 is a schematic view of a prior art oil delivery system.

FIG. 1 is a schematic drawing of a prior art oil delivery system. Oil is supplied at the appropriate temperature and pressure and in the appropriate state of cleanliness from oil console 120 to line 122. Oil flows through line 122, through level control valve 154, through line 126, through check valve 124, and through line 135 to line 138 and therefrom to seals 116 and 118 of compressor 110. Oil flows through the seals and then through return lines 140 from seals 116 and 118 to return line 142 back to oil console 120.

In addition oil flows from line 135 to line 136 to tank 130. A sufficient quantity of oil is maintained in the tank to at least partially fill tank 130. Level control sensor 152 is mounted to the side of tank 130 and is positioned to detect the level of oil within the tank. Level control valve 154 is controlled by level controller 152 and acts to regulate the volume flow of oil through line 126. When level controller 152 senses the oil level in tank 130 is too low, it acts to open level control valve 154 such that additional oil is supplied through line 126. Since the seal clearances within seals 116 and 118 allow only a desired flow of oil therethrough the additional oil flow supplied through line 126 is routed through line 136 to tank 130 causing the oil level in the tank to increase. Level controller 152 acts in the opposite manner when the oil level is too high such that the level control valve 154 is closed and a portion of the oil flowing to the seals is then supplied from tank 130 as well as the remainder of the oil being supplied from oil console 120.

Check valve 124 is positioned in line 126 such that oil flow from tank 130 may not flow to oil console 120 but instead must flow to a compressor 110.

Compressor 110 receives fluid through inlet 112 and discharges that fluid through outlet 114. Typically the fluid being discharged is at a higher temperature and lower pressure than when it was received. Balancing line 160 is connected between inlet 112 and tank 130 such that the pressure of the gas at the top of tank 130 is maintained at an equivalent level to the pressure of the fluid entering the compressor.

Tank 130 is utilized to provide a supply of oil under pressure should oil console 120 fail for some reason. In the event of a power outage such that oil console 120 did not act to supply oil under pressure then oil contained in tank 130 would be utilized to supply lubricant under pressure to seals 116 and 118. Once the oil console 120 shuts down the oil contained in tank 130 flows through line 136, through line 135, and through line 138 to the seals. The mere failure of flow from the oil console is sufficient to allow the oil to flow from the tank to supply the desired amount of oil to the seals.

Figure 2:
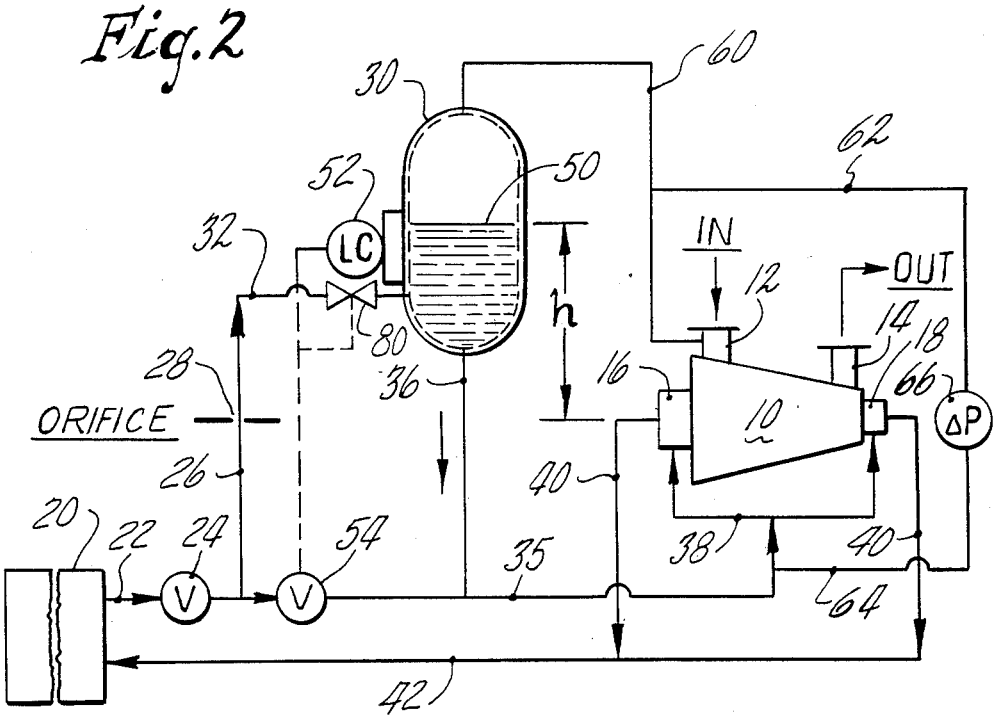
FIG. 2 is a schematic drawing of the herein described improved oil delivery system.

FIG. 2 is a schematic drawing of the improved oil delivery system wherein the temperature of the oil within the overhead tank is maintained at the desired level. In FIG. 2 the reference numerals correspond to the numerals of FIG. 1 with the omission of the first digit. In FIG. 2 it may be seen that oil is supplied from oil console 20 through line 22, through check valve 24, through line 26, through level control valve 54, and through line 35 to lines 38 supplying seals 16 and 18 of compressor 10. Once discharged from the seals discharged oil flows through line 40 to line 42 and back to the oil console to complete the circuit. Compressor 10 is shown having inlet 12 and outlet 14 for discharging the working fluid.

Tank 30 is shown positioned vertically above the compressor a distance h and is connected via discharge line 36 to line 35 and via supply means including line 26, pressure restriction device or orifice 28, and supply line 32. Level controller 52 is shown for sensing the level of the oil in the tank and is shown connected to level control valve 54. In addition level controller 52 causes block valve 80 to close on a high oil level being detected indicating that further oil being supplied to the tank may overfill the tank. Balancing line 60 is shown extending from the inlet to the compressor to tank 30. Additionally pressure sensor 66 is shown to sense the pressure difference between the fluid in the balancing line 60 versus the oil being supplied via oil console 20 to the compressor bearings. Lines 64 and 62 are shown connecting pressure sensor 66 to balancing line 60 and supply line 35, respectively.

Pressure sensor 66 is used to determine the pressure differential of the oil being supplied to the seals relative to the pressure of the gas entering the compressor.

Typically the temperature of the oil being discharged from the oil console will be higher than the temperature of the oil maintained in the overhead tank since the overhead tank may be mounted in ambient air of significantly lower temperatures and since the oil being circulated through the compressor seals is heated by the compressor. As shown in FIG. 2, oil being discharged from the oil control passes through check valve 24 and then a portion thereof may flow through line 26 and through orifice 28 and valve 80 to tank 30. Since it is desired to maintain the level of the tank at a preselected height the equivalent amount of oil flowing into the tank is discharged from the tank through line 36 to be supplied to the seals. Level control valve 54 is positioned to divide the flow being discharged from the oil console such that a small portion of the oil flow flows through the supply line as restricted by orifice 28 to the tank and the bulk of the oil flow passed directly to the compressor seals. An equivalent amount of oil as the oil being supplied through the supply line to the tank flows from the tank out the discharge line 36 to the compressor. Check valve 24 is maintained upstream from the supply line to the tank such that in the event of oil console failure oil will not flow from the tank to the oil console but will in turn be directed as desired to the compressor seals. The oil flowing through the supply line to the tank mixes with the oil in the tank such that the oil in the tank is maintained near the temperature of the oil being supplied thereto. By this manner should a failure occur the oil from the oil tank being supplied to the seals will be at the same temperature and pressure as the oil being supplied from the oil console such that an appropriate amount of oil will be available to the seals to provide the desired sealing effect. Since the amount of oil flow through the supply line into the tank and from the discharge line from the overhead tank to maintain the tank at this desired temperature level is small, the desired static pressure difference provided by the height difference between the tank and the compressor is maintained while allowing for the small amount of flow. Should a large flow be required then it would be difficult to maintain this desired static pressure difference.

The invention has been described with reference to a particular embodiment. It is to be understood by those skilled in the art that variations and modifications can be effected within the spirit and scope of the invention.

I claim:

1. An oil delivery system for supplying oil to seal a portion of a turbomachine having a pressurized fluid flowing therethrough which comprises:

an oil supply means for supplying oil under pressure to the turbomachine and for receiving oil from the turbomachine;

first conduit means connecting the oil supply means to the turbomachine;

second conduit means connecting the turbomachine to the oil supply means;

a tank a least partially filled with oil and connected at a first location by a discharge line to the first conduit means and mounted at an elevation sufficiently above the turbomachine that oil may be routed from the tank through the discharge line and first conduit means to the turbomachine at a pressure higher than the pressure of the fluid received by the turbomachine; and means for altering the temperature of the oil in the tank to approximate the operating temperature of the oil in the oil delivery system including a supply line connected between the first conduit means and a second location on the tank for routing a portion of the oil flowing from the oil supply means through the supply line, through the tank and through the discharge line to the turbomachine whereby oil from the supply means is mixed with the oil in the tank to maintain the temperature of the oil in the tank similar to the temperature of the oil discharged from the oil supply means.

2. The apparatus as set forth in claim 1 wherein the means for routing includes a supply line having a flow restriction extending from the first conduit means upstream of the discharge line to the tank such that a small portion of the oil flowing through the first conduit means is directed into the tank through the supply line.

3. The apparatus as set forth in claim 2 and further comprising a level controller mounted to the tank for ascertaining the level of the oil within the tank and a level control valve for controlling the volume flow of oil through the first conduit means between the connection of the supply line and the discharge line to the first conduit means, said valve acting in response to the level sensed by the level controller to regulate the oil flowing through the first conduit means to thereby regulate the volume flow rate of oil to the tank through the supply line.

4. The apparatus as set forth in claim 3 and further comprising a one-way valve located in the first conduit means upstream from the junction of the supply line therewith to prevent the flow of oil from the first conduit means to the oil supply means.

5. A method of maintaining a reliable alternate source of oil using a tank positioned vertically above a turbomachine while maintaining the desired relative pressure of the oil supplied from the tank, said tank being a portion of an oil delivery system for supplying oil to seal a portion of the turbomachine and including an oil supply means for supplying oil under pressure and for receiving oil, first conduit means for conducting oil from the oil supply means to the turbomachine, second conduit means for conducting oil from the turbomachine to the oil supply means and a discharge line connecting the tank at a first location to the first conduit means which comprises the steps of:

regulating the temperature of the oil in the tank to maintain the desired oil flow characteristics which includes routing a portion of the oil discharged from the oil supply means to the first conduit means to the tank at a second location, passing said oil through the tank to mix with the oil in the tank to maintain the temperature of the oil in the tank similar to the temperature of the oil supplied and discharging oil from the tank through the discharge line connected to the tank at the first location.

6. The method as set forth in claim 5 wherein the step of routing further comprises:

sensing the level of oil in the tank; and controlling the flow of oil through the tank in response to the sensed level of oil in the tank.

7. The method as set forth in claim 6 wherein the step of controlling further comprises:

positioning a valve in the first conduit means upstream from the connection of the discharge line with the first conduit means and downstream from where the oil for the step of routing is removed to thereby control the volume flow rate through the first conduit means which further acts to control the flow rate for the step of routing.

8. The method as set forth in claim 5 and further comprising discharging a portion of the oil in the tank through the discharge line to the turbomachine such that the tank level may be maintained constant while the tank receives a flow of temperature conditioned oil from the step of routing.

* * * * *